US007834727B2

(12) United States Patent
Delamare et al.

(10) Patent No.: US 7,834,727 B2
(45) Date of Patent: Nov. 16, 2010

(54) LEVITATION MAGNETIC ACTUATOR

(75) Inventors: Jerome Delamare, Grenoble (FR); Orphee Cugat, Poisat (FR); Christel Dieppedale, Crolles (FR); Jerome Meunier-Carus, La Tour du Pin (FR)

(73) Assignees: Commissariat a L'Energie Atomique, Paris (FR); Institut National Polytechnique de Grenoble, Grenoble (FR); Universite Joseph Fourier, Grenoble (FR); Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 10/562,748

(22) PCT Filed: Jul. 15, 2004

(86) PCT No.: PCT/FR2004/050331

§ 371 (c)(1),
(2), (4) Date: Dec. 29, 2005

(87) PCT Pub. No.: WO2005/010897

PCT Pub. Date: Feb. 3, 2005

(65) Prior Publication Data

US 2006/0145796 A1 Jul. 6, 2006

(30) Foreign Application Priority Data

Jul. 17, 2003 (FR) ..... 03 50347

(51) Int. Cl.
*H01F 7/08* (2006.01)

(52) U.S. Cl. ..... 335/279; 335/229; 335/234; 335/270; 335/282; 335/297; 335/299

(58) Field of Classification Search ..... 335/205–207, 335/229–234, 296–299, 306; 310/90.5
See application file for complete search history.

(56) References Cited

U.S. PATENT DOCUMENTS

| | | | | |
|---|---|---|---|---|
| 2,554,538 | A * | 5/1951 | Murphy | 310/29 |
| 4,491,759 | A * | 1/1985 | Kunz et al. | 310/328 |
| 4,798,488 | A * | 1/1989 | Uozumi | 400/124.21 |
| 4,812,884 | A * | 3/1989 | Mohler | 335/258 |
| 4,845,451 | A * | 7/1989 | Uetsuhara et al. | 335/257 |
| 6,737,946 | B2 * | 5/2004 | Seale et al. | 335/279 |
| 6,916,004 | B2 * | 7/2005 | Suzuki | 251/129.15 |
| 2001/0030307 | A1 * | 10/2001 | Bergstrom et al. | 251/129.15 |

FOREIGN PATENT DOCUMENTS

| | | |
|---|---|---|
| FR | 2 828 000 | 1/2003 |
| JP | 9-252570 | 9/1997 |

* cited by examiner

*Primary Examiner*—Ramon M Barrera
(74) *Attorney, Agent, or Firm*—Pearne & Gordon LLP

(57) ABSTRACT

This is a magnetic actuator including a mobile magnetic portion (20), a fixed magnetic portion (10) provided with at least two attraction areas (11, 12) for the mobile magnetic portion (20), and means (30) for triggering the displacement of the mobile magnetic portion (20), the mobile magnetic portion (20) being in levitation when it is not in contact with an attraction area (11, 12). The mobile magnetic portion (20) includes a magnet-based part (200) with reduced magnet weight, this part (200) having an overall volume, and a mass which is less than the one it would have if its overall volume was totally occupied by the magnet.

15 Claims, 12 Drawing Sheets

LEVITATION MAGNETIC ACTUATOR

TECHNICAL FIELD

The object of the present invention is a magnetic levitation actuator and notably a micro-actuator which may be made by microtechnology techniques.

These magnetic actuators have a mobile magnetic portion and a fixed magnetic portion. The mobile magnetic portion is in levitation when it is not stuck to the fixed magnetic portion. Such actuators are very promising and in the future they may very well compete with transistor systems for performing switching.

STATE OF THE PRIOR ART

A magnetic actuator which includes as in FIGS. 1A, 1B, 1C, a mobile magnetic portion 1, a fixed magnetic portion 2, having at least two attraction areas 2.1, 2.2 for the mobile magnetic portion 1, and means 3 for triggering the displacement of the mobile magnetic portion 1, is known by French Patent application FR-A1-2,828,000 filed on Jul. 27, 2001 on behalf of the applicant. The mobile magnetic portion is formed with a magnet shaped as a rectangular plate. When it is not stuck on one of the attraction areas 2.1, 2.2, the mobile magnetic portion 1 is in levitation between both attraction areas 2.1, 2.2. In the figures, both attraction areas 2.1, 2.2 each correspond to a pair of split magnets 2.1*a*, 2.1*b* and 2.2*a*, 2.2*b*. Each magnet 2.1*a*, 2.1*b* and 2.2*a*, 2.2*b* is provided with an electric contact C11, C12 and C21, C22, respectively. The mobile magnetic portion 1 is also provided with electric contacts C1, C2 placed on opposite faces which are the faces which come into contact with the fixed magnetic portion 2. When the mobile magnetic portion 1 is stuck on the left attraction area 2.1, the contact C1 of the mobile magnetic portion 1 will electrically connect both contacts C11, C12 of the attraction area 2.1 and when the mobile magnetic portion 1 is stuck on the right attraction area 2.2, its contact C2 will electrically connect both contacts C21, C22 of the attraction area 2.2. The arrows illustrate the current which flows between both contacts, in both situations. Triggering of the movement of the mobile magnet is initiated by a current pulse sent into the means 3 for triggering the displacement which are illustrated in this example by a coil with several turns placed under the assembly formed by mobile magnetic portion 1 and the fixed magnetic portion 2.

As compared with transistor switches, such magnetic levitation switches and generally mechanical contactors have a drawback which is that their switching time is not insignificant, it is of at least a few microseconds. Another drawback exhibited by these actuators is that the quality of the electric contact may very well deteriorate after a large number of switchings.

Another drawback of these magnetic levitation switches is that they consume significant current upon switching.

On the other hand, they have the advantage that when they are in a stable position, their mobile magnetic portion being stuck against the fixed magnetic portion, they do not consume any electric power. This is not the case for transistors which when they are at rest, consume a little power and need to be continually supplied with power.

DISCUSSION OF THE INVENTION

The object of the present invention is to provide a magnetic levitation actuator which has reduced switching time and/or actuating current zs compared with actuators of the prior art.

Another object of the invention is to provide a magnetic actuator with reduced current consumption during switching.

Another object of the invention is to provide a magnetic actuator with an improved and durable contact quality.

Another object of the invention is to provide a magnetic actuator, the mobile magnetic portion of which has increased angular stability.

In order to achieve these objects, the present invention is a magnetic actuator including a mobile magnetic portion, a fixed magnetic portion, provided with at least two attraction areas for the mobile magnetic portion, and means for triggering the displacement of the mobile magnetic portion, the mobile magnetic portion being in levitation when it is not in contact with an attraction area. The mobile magnetic portion includes a magnet-based part with reduced magnet weight, this part having an overall volume, and a mass which is less than the one it would have if its overall volume was totally occupied by the magnet.

Thus, by means of the part with reduced magnet weight, the mass of the mobile magnetic portion is reduced, the latter is switched more rapidly for a given actuating force or else a reduced actuating current is required for actuation for a given switching time. It is possible to act both on the switching time and on the actuating current.

The part with reduced magnet weight may be formed with one or several magnets provided at least with one recess.

The recess may be a through-hole. It may be filled with solid material having lesser density, less than that of the magnet.

The solid material with lesser density may be selected from semiconducting material, plastic material, dielectric material, soft magnetic material, according to the configuration.

In one alternative, the recess may be empty of solid material.

The part with reduced magnet weight may be a substantially rectangular plate.

It is possible that it includes a magnet frame.

In an alternative with which the current required for displacement may be reduced, the part with reduced magnet weight may include, in the direction of the displacement, a succession of magnets spaced apart from each other, these magnets having a same direction of magnetization.

For the same purpose, the part with reduced magnet weight may include, in the direction of the displacement, an alternating succession of magnets, and of at least one solid portion of lesser density.

The magnets may be in the form of orientated bars substantially normal to the displacement.

In order to maximize the contact force, it is advantageous if the succession includes a magnet at each end. However, depending on the applications or on the magnetic characteristics of the magnets, it may also be of interest to have at each end of the succession, a material other than the one used for the magnets of the succession.

In order to reduce the total current required for the displacement, the means for triggering the displacement may include at least one conductor arranged as a meander formed with sections of successive conductors in which a current is able to flow in opposite directions, each of the magnets of the succession working together, when the mobile magnetic portion is stuck on an attraction area, with one of the sections, the current flowing in the same direction in these sections.

In order to simplify the bidirectional control, it is preferable if the end magnets have a dimension, in the sense of the displacement, substantially equal to the displacement.

In another particularly stable alternative, the part with reduced magnet weight includes at least one central magnet at least partially surrounded by at least a portion of lesser density, this central magnet being in the form of a substantially rounded or ovoid pad.

In order to enhance the contact force, when the mobile magnetic portion is stuck on an attraction area, the mobile magnetic portion may include at least one face, which should stick onto the attraction area, this face being curved.

Instead of being curved, this face may be zigzagged.

In these configurations, each attraction area has a geometry conjugate to that of the face of the mobile magnetic portion which should come into contact with it.

It is possible to provide, notably in the case of RF contactors, that at least one of the attraction areas includes a dielectric portion so as to achieve capacitive contact when the mobile magnetic portion is stuck on said attraction area.

With the same purpose, the part with reduced magnet weight may include a dielectric portion so as to achieve capacitive contact when the mobile magnetic portion is stuck on one of the attraction areas.

The present invention also relates to a method for making a magnetic actuator of this type. It includes the following steps:

on a first substrate, making cases able to receive magnets from a fixed magnetic portion and from a part with reduced magnet weight of a mobile magnetic portion, this part with reduced magnet weight, having an overall volume, and a mass which is less than that it would have if its overall volume was totally occupied by the magnet, depositing magnets in the cases, depositing a dielectric layer and etching the latter in order to expose the part with reduced magnet weight of the mobile magnetic portion, and its surroundings up to the fixed magnetic portion, on the second substrate, making at least one case capable of receiving a conductor for triggering a displacement of the mobile magnetic portion, depositing the conductor in the case, assembling both substrates by placing them face to face, totally or partially removing the first substrate so as to release the part with reduced magnet weight from the mobile magnetic portion.

It may also include a step for magnetizing the magnet of the part with reduced magnet weight of the mobile magnetic portion and possibly of the fixed magnetic portion before releasing the part with reduced magnet weight.

The step for etching the dielectric layer of the first substrate may aim at achieving at least one aperture for accessing at least one electric contact for supplying power to the conductor.

The step for etching the dielectric layer may be followed by a step for etching the first substrate around the part with reduced magnet weight and at the level of at least one portion of lesser density with which the part with reduced magnet weight is provided.

In one alternative, the step for etching the dielectric layer may be followed by a step for etching the first substrate around the part with reduced magnet weight by masking at least one portion of lesser density with which the part with reduced magnet weight is provided, this portion of lesser density being full of the material of the substrate.

The method may include a step for achieving at least one electric contact for supplying power to the conductor on the second substrate after depositing the conductor and before assembling both substrates.

A step for depositing a dielectric material on the surface of the second substrate before assembling both substrates may be provided. This dielectric material may be used for protecting the conductor.

The substrates may be massive or SOI type semiconductor substrates.

SHORT DESCRIPTION OF THE DRAWINGS

The present invention will be better understood upon reading the description of exemplary embodiments given as purely indicative and by no means limiting, with reference to the appended drawings wherein.

Identical, similar or equivalent portions of the different figures described hereafter, bear the same numerical references so as to facilitate, passing from one figure to another.

The different portions in the figures are not necessarily illustrated according to a uniform scale, in order to make the figures more legible.

These different alternatives should be understood as not excluding each other.

DETAILED DISCUSSION OF PARTICULAR EMBODIMENTS

Reference is made to FIGS. 2A-2J which show different possible configurations for the mobile magnetic portion 20, the fixed magnetic portion 10 and the means 30 for triggering the displacement of the mobile magnetic portion 20 of a magnetic actuator according to the invention. This displacement is performed in a plane x, y, along the x axis.

The switching time of a magnetic for a given magnetic force applied on the mobile magnetic portion, is proportional to the mass of the mobile magnetic portion. In order that the mobile magnetic portion translationally moves between two attraction areas without being submitted to a side shift, its dimension in the direction of displacement should be large relatively to its two other dimensions. This is why the mobile magnetic portion generally is a rectangular magnet plate, the length of which is directed in the direction of the displacement. These considerations cause such a mobile magnetic portion to have a relatively significant volume and therefore a relatively significant mass (the densities of the magnets generally are high).

But in fact, only the volumes of magnets found facing the attraction areas of the fixed magnetic portion, are involved in the bistability of the actuator. Bistability refers to the two stable positions of the mobile magnetic portion against the attraction areas of the fixed magnetic portion. On the other hand, triggering of the displacement is caused by the assembly of magnets plus displacement triggering means (these means will be described in detail later on). The central portion of the mobile magnetic portion does not need to be a magnet (if there is no conductor of the displacement triggering means at this central portion). The invention therefore consists of making the mobile magnetic portion as a part with reduced magnet volume so that it has a mass which is less than the one it would have if its overall-volume was totally occupied by the magnet. Thus, for a same force and same pressure, applied on the mobile magnetic portion, its mass is reduced and the switching time and/or the required actuating current are reduced.

Figure 1A:
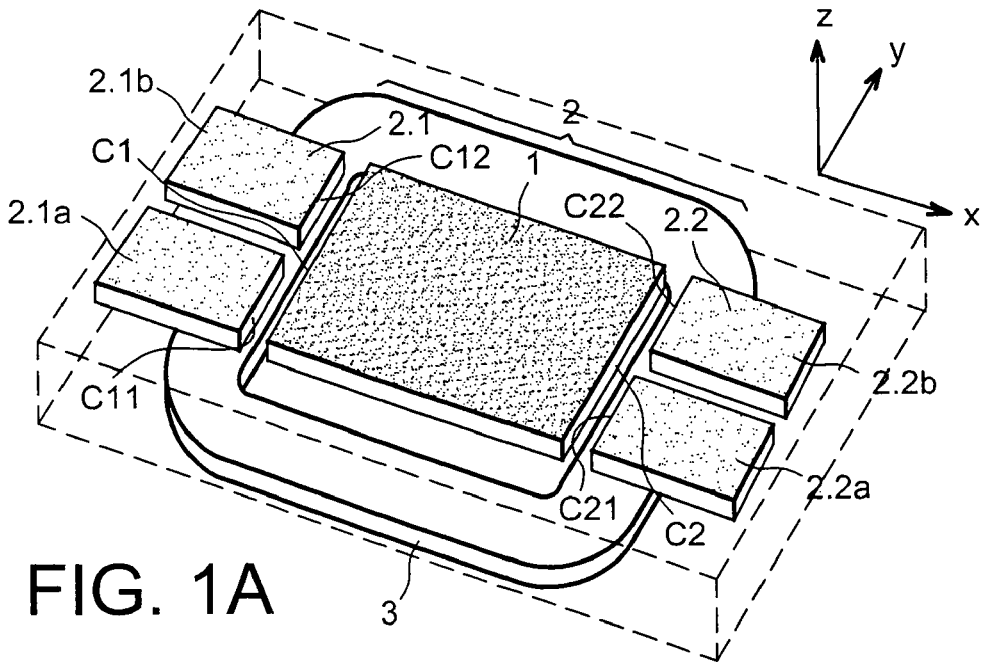
FIGS. 1A, 1B, 1C show a known magnetic actuator.
Figure 1B:
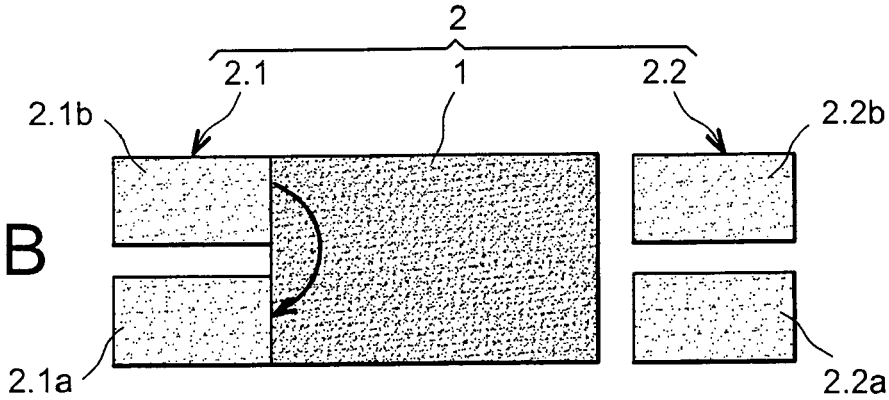
Figure 1C:
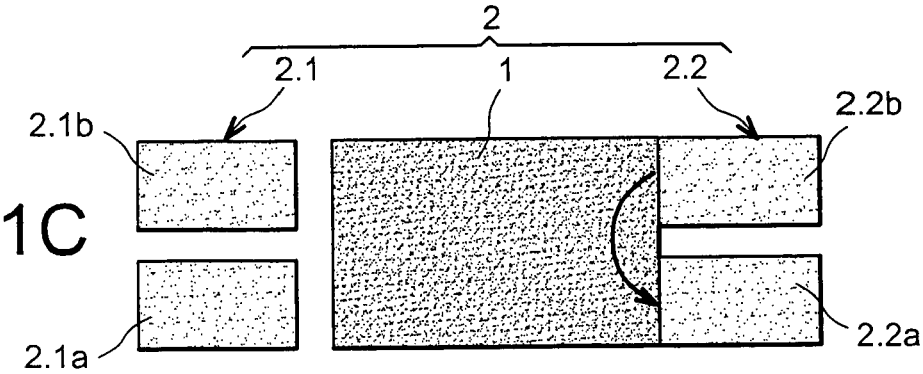
Figure 2A:
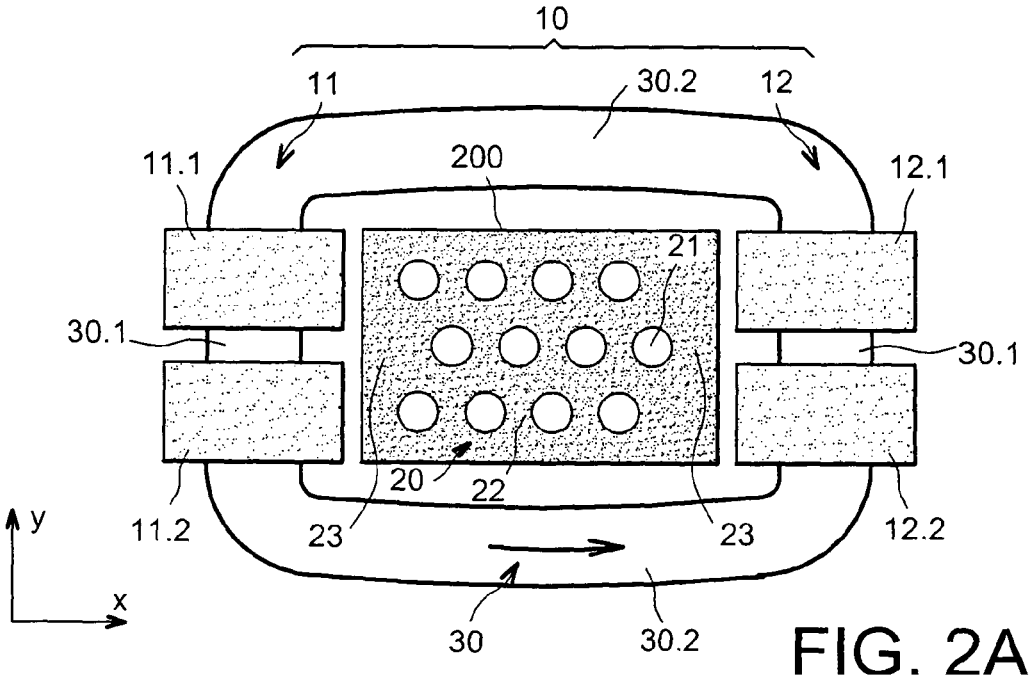
FIGS. 2A-2J show different alternatives of a magnetic actuator according to the invention.

FIG. 2A shows a top view of a magnetic actuator according to the invention wherein the fixed magnetic portion 10 includes two attraction areas 11, 12, facing each other, each formed with a pair of magnetic blocks 11.1 and 11.2, 12.1 and 12.2, separated as in FIGS. 1A-1C.

The fixed magnetic portion may be made in a material selected from the group of soft magnetic materials, hard magnetic materials, hysteretic materials, these materials either being taken alone, or in combination with each other, or with supraconducting materials, diamagnetic materials. Soft magnetic materials such as iron, nickel, alloys based on iron-nickel, iron-cobalt, iron-silicon, etc., become magnetized depending on an inducting field to which they are submitted. Hard magnetic materials correspond to magnets such as ferrite magnets, magnets based on samarium-cobalt, magnets based on neodymium-iron-boron, magnets based on platinum-cobalt, iron-platinum, for example. Their magnetization is little dependent on the external magnetic field. Hysteretic materials for example of the aluminium-nickel-cobalt type (AlNiCo), have properties which are located between those of soft magnetic materials and those of hard magnetic materials. They are sensitive to the magnetic field in which they are found. As for diamagnetic materials, such as bismuth or pyrolitic graphite, their magnetization is collinear with the inducting magnetic field but of opposite direction. Supraconducting materials may be alloys based on niobium-titanium (NbTi), yttrium-barium-copper-oxygen (YBaCuO) for example.

The mobile magnetic portion 20 illustrated in this example, is located between attraction areas 11, 12 and therefore is in levitation. It includes a part 200 with reduced magnet weight which is formed with at least one magnet 22 provided with recesses 21. These recesses 21 may be through-holes or blind holes. The holes 21 are directed in the direction of the thickness of the magnet 22. This illustration is not limitative, the recesses 21 may assume another direction. The part 200 with reduced magnet weight and therefore also the magnet 22 are in the form of a substantially parallelepipedous plate.

The recesses 21 are preferably concentrated in the central portion of the magnet 22 and they spare its edges 23 which are facing both attraction areas 11, 12 of the fixed magnetic portion 10. These edges 23 are full and their dimension in the direction of the displacement is substantially equal to the distance travelled by the mobile magnetic portion 20 when it leaves one of the two attraction areas, for example 11, and will stick onto the other attraction area 12. This distance is subsequently called a gap and is referenced as e in FIG. 2B. In the example of FIG. 2A, the recesses 21 of the magnet 22 are empty of solid material. Thus, the mass of the part 200 with reduced magnet weight is less than the one it would have in the absence of recesses 21.

The magnet 22 may be made in ferrite, be based on samarium-cobalt, neodymium-iron-boron, platinum-cobalt, iron-platinum, for example.

The recesses 21 have been distributed in a substantially regular way in the magnet 22 but this is not mandatory. In the same way, they do not all have the same dimension necessarily.

Instead of having several recesses, the magnet may only have a single one. Instead of the recesses being empty of solid material, they may be filled with a material, the density of which is less than that of the magnet as in FIG. 2B. This material is subsequently called a material of lesser density. Its density is less than that of the magnet. For example, one may imagine plastic material, dielectric material, semiconducting material such as silicon or even soft magnetic material such as iron, nickel, alloys based on iron-nickel, iron-cobalt, iron-silicon, etc.

Importantly, it is the part 200 with reduced magnet weight which has a mass less than that it would have if its overall volume was made in massive magnet. Overall volume means the total volume which includes the volume of the recesses when they are empty of solid material. With this principle, it is possible to gain up to about 90% on the mass of the mobile magnetic portion and therefore to divide the switching time by about 10 as compared with a conventional configuration with a mobile magnetic portion made out of massive magnet.

The means 30 for triggering the displacement of the mobile magnetic portion 20 have been illustrated as a coil 30 with one or more turns placed under the assembly consisting of the mobile magnetic portion 20 and of the fixed magnetic portion 10.

Contacts between the mobile magnetic portion 20 and the attraction areas 11, 12 have been illustrated as resistive, i.e., ohmic or dry contacts. The magnet 22 comes into direct electric contact with either one of the pairs of magnetic blocks 11.1 and 11.2, 12.1 and 12.2.

Figure 2B:
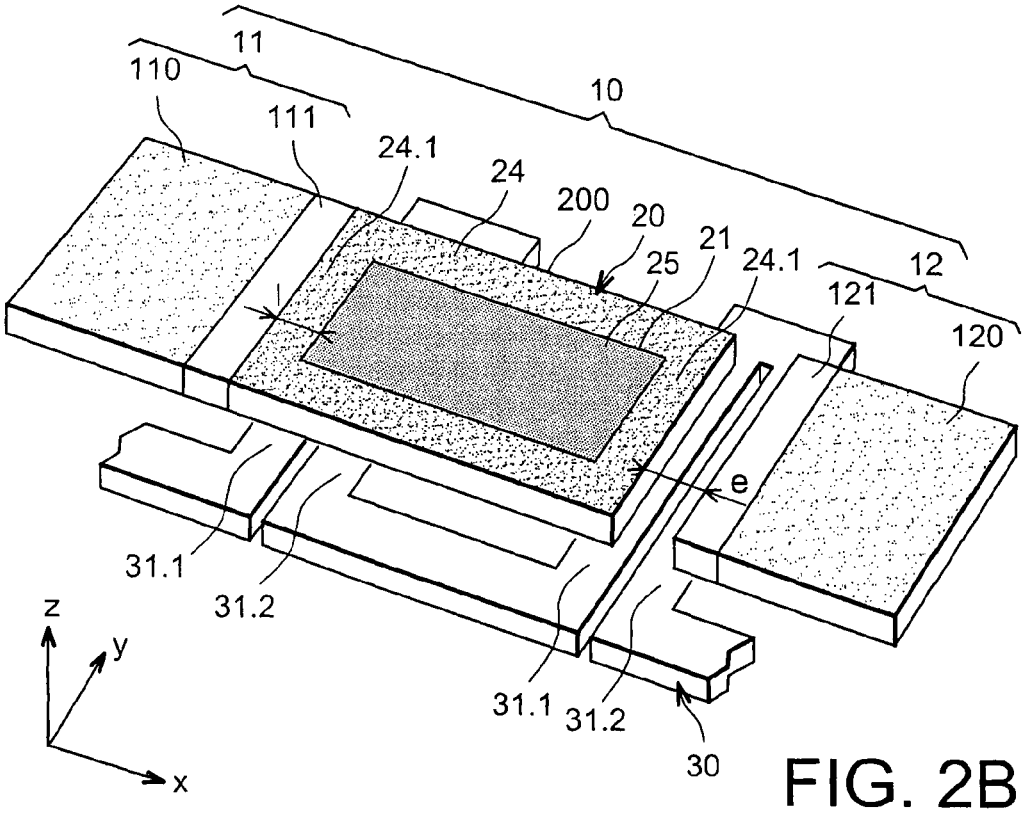

In FIG. 2B, the fixed magnetic portion 10 now includes two attraction areas 11, 12 facing each other, each formed with a magnet 110, 120 and a dielectric portion 111, 121 placed side by side. The mobile magnetic portion 20 will stick onto either one of the dielectric portions 111 or 121 so as to form a so-called capacitive contact. One of the advantages of capacitive contacts is that they are less subject to wear than resistive contacts.

The part 200 with reduced magnet weight of the mobile magnetic portion 20 is a substantially rectangular plate and includes a magnet 24 in the form of a frame delimiting a single through-hole 21 filled with material 25, the density of which is less than that of the magnet. The frame is substantially rectangular with bars, two of which (referenced as 24.1) are facing the attraction areas 11, 12. Of course the single through-hole 21 might be empty of solid material, as those of FIG. 2A. In this FIG. 2B, the width 1 (dimension in the direction of the displacement) of a bar 24.1 facing the attraction areas 11, 12 of the fixed magnetic portion 10, is substantially equal to the gap e. The use of this hole for positioning an optical lens or a valve may be contemplated.

The means 30 for triggering the displacement of the mobile magnetic portion 20 are illustrated by a conductor configured as a meander placed under the mobile magnetic portion 20. They will be described in more detail later on, notably with reference to FIG. 2C which is a longitudinal sectional view of the actuator of FIG. 2B.

Figure 2C:
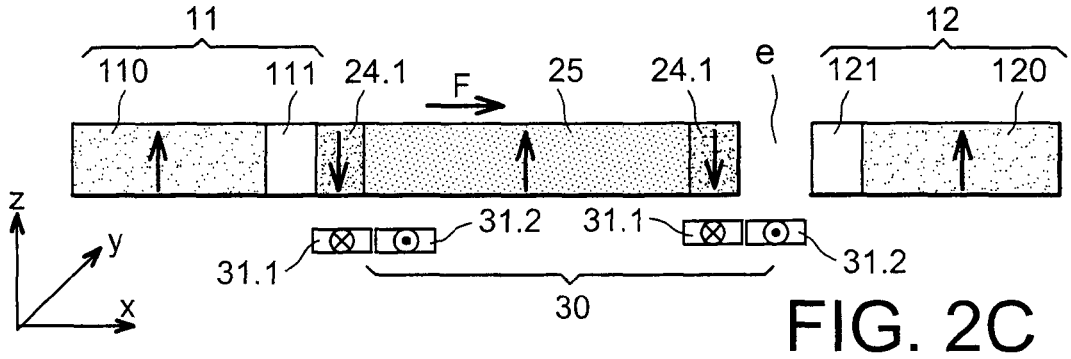
Figure 2D:
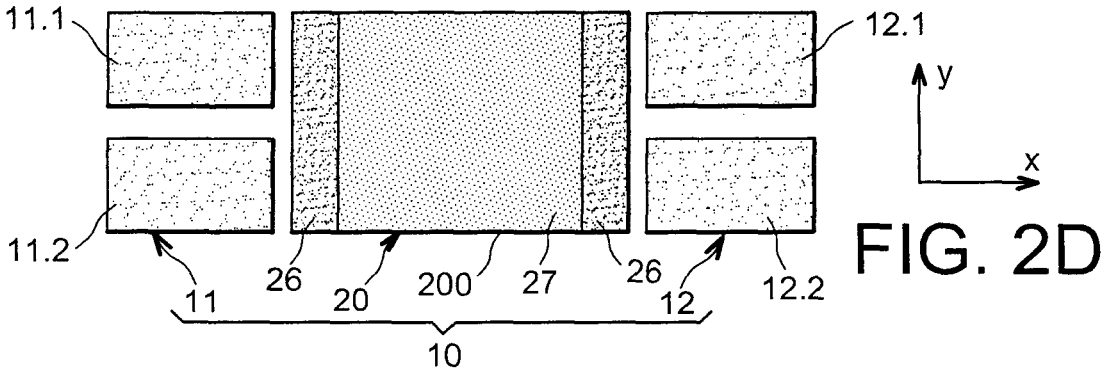

In FIG. 2D, the fixed magnetic portion 10 is similar to the one of FIG. 2A, the means for triggering the displacement of the mobile magnetic portion are not illustrated so as not, to overload the figure.

The part 200 with reduced magnet weight of the mobile magnetic portion 20 includes two magnets 26 with a lesser density portion 27 sandwiched between them. The lesser density portion 27 is a substantially square plate. The part 200 has the shape of a substantially rectangular plate. The magnets 26, in the form of bars, are located facing the attraction areas 11, 12 of the fixed magnetic portion 10. As in the previous examples, the material of the lesser density portion 27 may for example be plastic material, dielectric material, silicon, or even soft magnetic material.

Figure 2E:
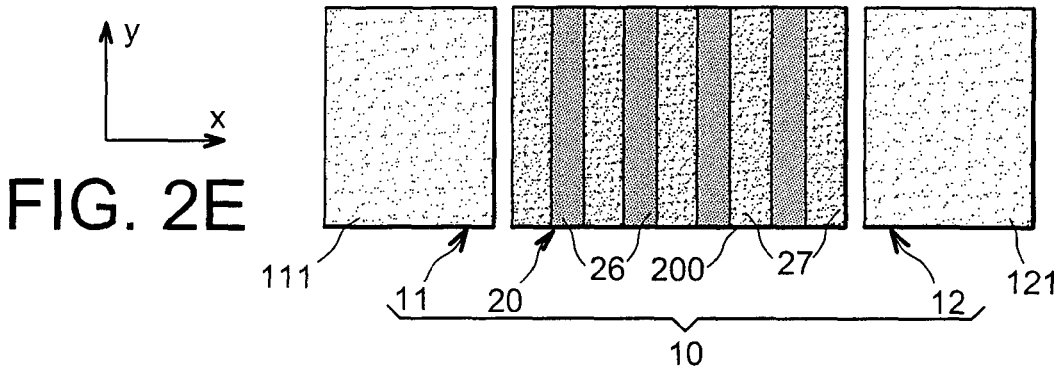
Figure 2F:
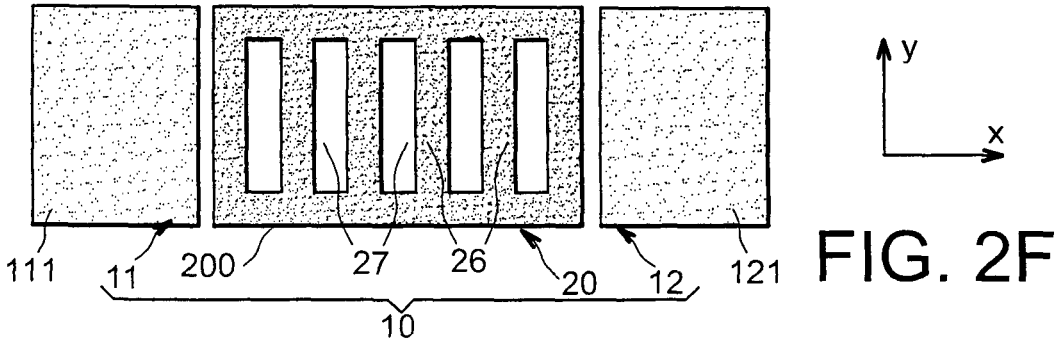

In FIG. 2E, the part 200 with reduced magnet weight is formed in the direction of the displacement, with an alternating succession of magnets 26 and of lesser density portions 27, magnets 26 ending the succession. It may be contemplated that it is not a magnet which ends the succession, notably if provision is made for achieving capacitive contact. The terminal magnets 26 face the attraction areas 11, 12 of the fixed magnetic portion 10. The magnets 26 and the lesser density portions 27 are in the form of bars. The lesser density portions 26 may be made in solid material but one may imagine that they correspond to recesses. This last configuration is illustrated in FIG. 2F. In this last figure, the part 200 with reduced magnet weight is a grid-shaped magnet and the magnet bars 26 are firmly attached to each other at their two ends.

In FIGS. 2E, 2F, the fixed magnetic portion 10 is formed with two magnetic parts 111, 121 facing each other, each forming an attraction area 11, 12. The magnets 26 are massive but this not mandatory, they may be provided with at least one recess. The same applies to the lesser density portions 27 if they are solid.

The end magnets 26 have a width in the sense of the displacement which is substantially equal to that of the gap.

In the example illustrated in FIG. 2E, the magnets 26 and the lesser density portions 27 have substantially the same dimensions. This is not mandatory. The part 200 with reduced magnet weight has the shape of a substantially rectangular plate.

Figure 2G:
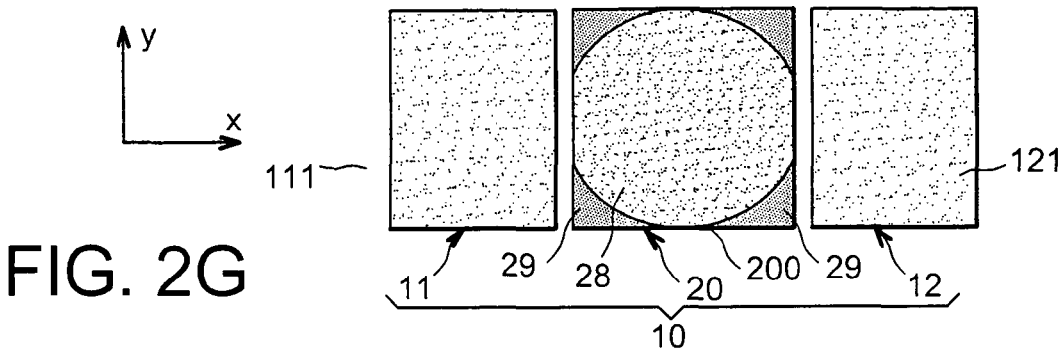

In FIG. 2G, the mobile magnetic portion 20 includes a part 200 with reduced magnet weight formed with a solid central magnet 28 with globally rounded edges, surrounded at least partially by one or several lesser density portions 29. These lesser density portions 29 may be magnetic or amagnetic, dielectric or electrically conducting. Such a magnet 28 may assume the shape of a substantially circular or slightly ovoid pad (its width is close to its length). This pad may also include at least a rectilinear edge portion. Thus, by giving the magnet such a pad shape, the mobile magnetic portion 20 may be made more stable angularly. There is less risk that it shifts during its displacement angularly. By reducing its dimension in the sense of the displacement relatively to the configuration with a substantially parallelepipedous magnet, one reduces its mass. The fixed magnetic portion 10 is similar to the one of FIG. 2E.

The lesser density portions 29 are used for completing the magnet 28 so that the faces of the part 200 with reduced magnet weight, facing the attraction areas 11, 12, are adapted to the geometry of said attraction areas 11, 12 so as to achieve optimum contact.

In the example of FIG. 2G, the attraction areas 11, 12 have a planar face facing the mobile magnetic portion 20. The lesser density portions 29, four in number in this example, may be described as corners which surround the pad-shaped magnet 28. Their main section is delimited by two sides at right angles linked by a circular arc. With the magnet 28, they contribute to form planar faces which should come and stick onto the attraction areas 11, 12. Other shapes are possible, of course. The part 200 with reduced magnet weight, with the corners 29, assumes the shape of a substantially rectangular plate.

If the material of the lesser density portions 29 is dielectric, provision may be made so that the magnet 28 (which itself may be electrically conducting) comes into direct contact with the attraction areas 11, 12 insofar that they are also conducting and that it is desired to achieve ohmic contact as in FIG. 2G. If capacitive contact is required, the lesser density portions 29 may totally mask the magnet 28 facing the attraction areas 11, 12 as in FIG. 2H. In this figure, the magnet 28 is a substantially ovoid central pad.

One might have as a mobile magnetic portion, a substantially ovoid solid magnet pad therefore without any materialized edge. It would have corners with reduced magnet weight, empty as compared with configurations of the prior art with a rectangular mobile magnetic portion. Now, if for having angular stability, the mobile magnetic portion includes a substantially ovoid magnet solid pad cooperating with edges, the latter will be in an electrically conducting or dielectric amagnetic material.

Figure 2I:
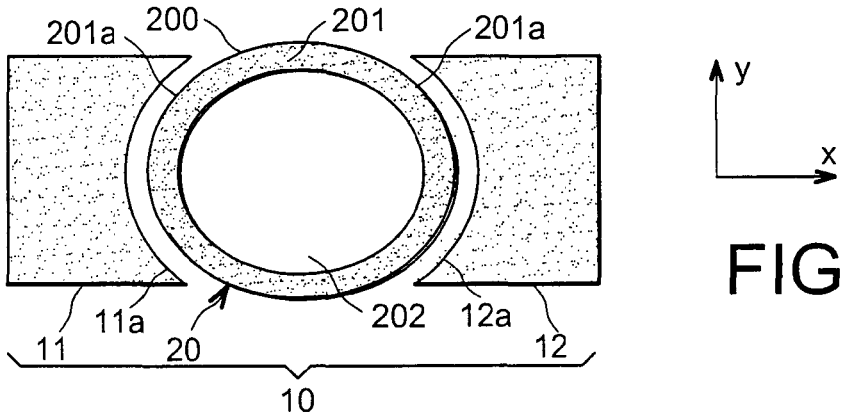
Figure 2H:
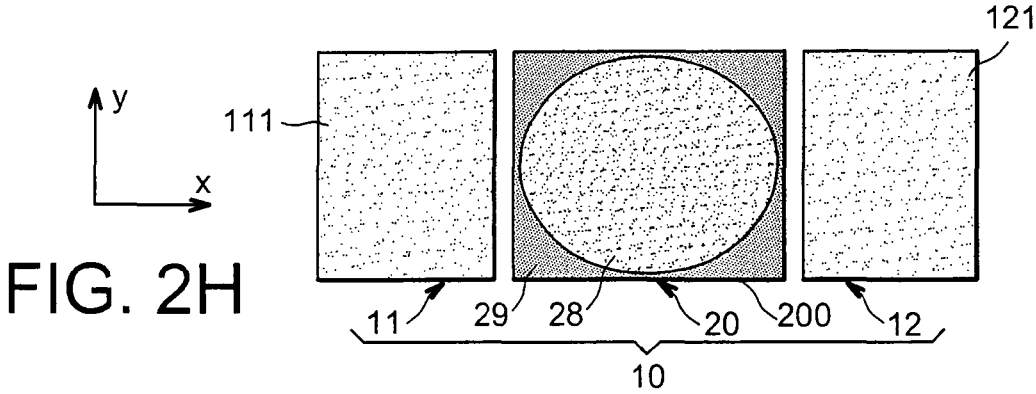

In FIG. 2I, the mobile magnetic portion 20 includes a part 200 with reduced magnet-weight, in the form of a substantially ovoid plate. It consists of a magnet frame 202 delimiting a central aperture 202 empty of solid material. This aperture 202 may of course be filled with lesser density material as described in FIG. 2B.

The faces 201*a* of the mobile magnetic portion 20 which are intended to come and stick on the attraction areas 11, 12 of the fixed magnetic portion 10, are also curved. The attraction areas 11, 12 each include a face 11*a*, 11*b*, with a shape conjugate to that of the part 200 with reduced magnet weight. The mobile magnetic portion 20 may come and be partially embedded into the attraction areas 11, 12. Thus, for a given section of the part 200 with reduced magnet weight, transverse to the displacement, the contact surface between the fixed magnetic portion and the mobile magnetic portion is increased as compared with the case when the contact faces are planar and perpendicular to the displacement as in FIG. 2B. The quality of the contact may then be enhanced, the latter varying in the same direction as the contact surface, whether this contact is ohmic or capacitive. Other shapes of curves may of course be contemplated since any curved surface may be broken down into a succession of small planar surfaces with a variable angle. In the simple case of FIG. 2J, the surface and the contact force F' are both increased by a factor $1/\sin \alpha$, the angle $\alpha$ being illustrated in FIG. 2J, between the force F' and a normal to the direction of the displacement.

Figure 2J:
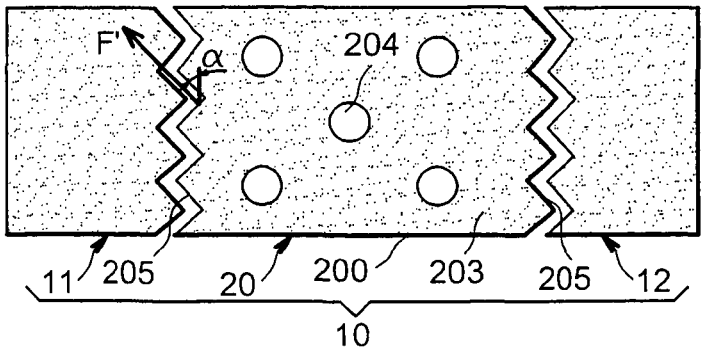

Instead of the faces of the part 200 with reduced magnet weight, intended to come and stick on the attraction areas 11, 12, being curved, they may also be jagged as in FIG. 2J.

The part 200 with reduced magnet weight is formed with a magnet 203 with recesses 204 (which are supposed to be non-throughgoing). The magnet 203 is plate-shaped and the recesses may be found at one of its main faces or at both main faces.

The part 200 with reduced magnet weight is therefore plate-shaped with zigzagged faces 205 which should stick to the attraction areas 11, 12. Each attraction area 11, 12 has a face with a conjugate shape onto which the mobile magnetic portion 20 should come and stick. Such a shape with one or several jags or at least substantially V-shaped also allows the contact force and/or surface to be increased as compared with the case when the edges are straight, normal to the displacement.

We will now refer back to the means for triggering the displacement of the mobile magnetic portion. In FIG. 2A, the means 30 for triggering the displacement of the mobile magnetic portion are illustrated by a conductor arranged as a loop, with one or several turns, placed in an x, y plane (which is the plane in which the mobile magnetic portion moves) under the assembly formed with the mobile magnetic portion 20 and the fixed magnetic portion 10. This loop includes a conductor section 30.1 facing each attraction area 11, 12. In each of these conductor sections 30.1, the current flows in reverse direction. An arrow (arbitrarily) shows the direction of the current in the conductor.

In this configuration, cooperation as regards the magnetic field between the looped conductor 30 and the part 200 with reduced magnetic weight, is not optimum. The main magnetic field created by the magnet 22 is orientated in the direction of the displacement (along x), it is used for achieving magnetic guiding of the mobile magnetic portion 20 when it is in levitation and for achieving bistability. Magnetic field leakage from the magnet 22 which combines with the electric current flowing in both conductor sections 30.1 located facing the attraction areas 11, 12, is utilized to initiate displacement.

The extraction force which is used for initiating displacement is proportional to the vector product of the intensity of the current in the conductor section 30.1 facing the attraction area 11 or 12 on which is stuck the part 200 with reduced magnet weight, and of the magnetic field exclusively created by the mobile magnetic portion and prevailing at said conductor section 30.1, according to Laplace's law. Now the magnetic field at this conductor section 30.1 is not optimum, as not all the magnetic field created by the magnet 22 of the part 200 with reduced magnet weight is used but only leakage. The sections (referenced as 30.2) of the conductor 30 which are not facing the attraction areas 11, 12 are not involved in the triggering of the displacement. In order that the force be sufficient for disengaging the part 200 with reduced magnet weight, significant current must flow in the conductor 30.

On the other hand, in FIGS. 2B, 2C, the part 200 with reduced magnet weight is a substantially rectangular frame with two magnet bars 24.1 facing the attraction areas 11, 12. These two magnet bars 24.1 have the same magnetization direction (illustrated by a downward arrow in FIG. 2C) and this magnetization direction follows the z axis. The means 30 for triggering the displacement of the mobile magnetic portion 20 are a conductor arranged as a meander with sections 31.1, 31.2 orientated like the bars 24.1. In two successive sections 31.1, 31.2, the current flows in opposite directions. The direction of the current is illustrated in FIG. 2C. One of the directions corresponds to an outgoing path and the other to a return path for the current. Each bar 24.1 is found above a conductor section 31.1 when it is stuck on an attraction area 11 and above a conductor section 31.2 when it is stuck on the attraction area 12. In these sections 31.1 or else 31.2 surmounted by a bar 24.1, the current flows in the same direction. There is strong cooperation between the field created by each of the bars 24.1 and the current which flows in the associated section 31.1 (in the case when the mobile magnetic portion 20 is stuck onto the attraction area 11) and this cooperation aims at creating a displacement force also called an actuating force of the mobile magnetic portion 20. The geometry of the meanders is not limited to simple Grecian geometry as in FIGS. 2. A more complex geometry such as a spiral meander extending in one or more superimposed planes.

At the lesser density portion 25, a magnetic field is also established which is of an opposite direction to the one generated by the magnet bars 24.1. This magnetic field stems from the leakage fields of the neighboring bars 24.1. This lesser density portion 25, which may be described as virtual as the frame is empty of any solid material, also cooperates with a conductor section 31.2 in order to initiate the triggering of the displacement when the mobile magnetic portion is stuck against an attraction area. The magnetic field in the lesser density portion 25 reinforces the one created by the conductor section 31.2 with which it cooperates. A given extraction force may be obtained with a weaker current than in the configuration of FIG. 2A. If there were several lesser density portions as in FIG. 2E, each would cooperate with a conductor section and in all these sections, the current would be directed in the same direction, in the same way as for the magnet bars.

When the mobile magnetic portion 20 is stuck against the attraction area 11, there will be an end conductor section 31.2 (the right one) which does not cooperate with a part of the mobile magnetic portion 20. This conductor section 31.2 is found at the gap e. However, when the mobile magnetic portion 20 has switched and is again found stuck onto the attraction area 12, this conductor section 31.2 finds its utility in the other direction since the current flows therein in the reverse direction and it is the other end conductor section 31.1 (located on the side of the attraction area 12) which does not participate in the triggering. Thus, with current pulses always in the same direction, triggering of the displacement towards either one of the attraction areas is achieved, regardless of the initial position of the mobile magnetic portion at rest.

Thus, regardless of the position of the mobile magnetic portion 20 in contact with an attraction area 11, 12, there is strong cooperation between the whole mobile magnetic portion 20 and the conductor 30. The obtained force is substantially proportional to the number of meanders. For a given force, capable of extracting the mobile magnetic portion 20 from an attraction area 11, 12, it is possible to reduce the intensity of the current flowing in the conductor 30.

Different steps will now be examined, for making an actuator according to the invention with microtechnology, this actuator being called microactuator subsequently. Several actuators may be made at the same time. In the figures, only one actuator is seen. These steps repeat the ones described in French Patent Application FR-A1-2 828 000 mentioned earlier.

Figure 6A:
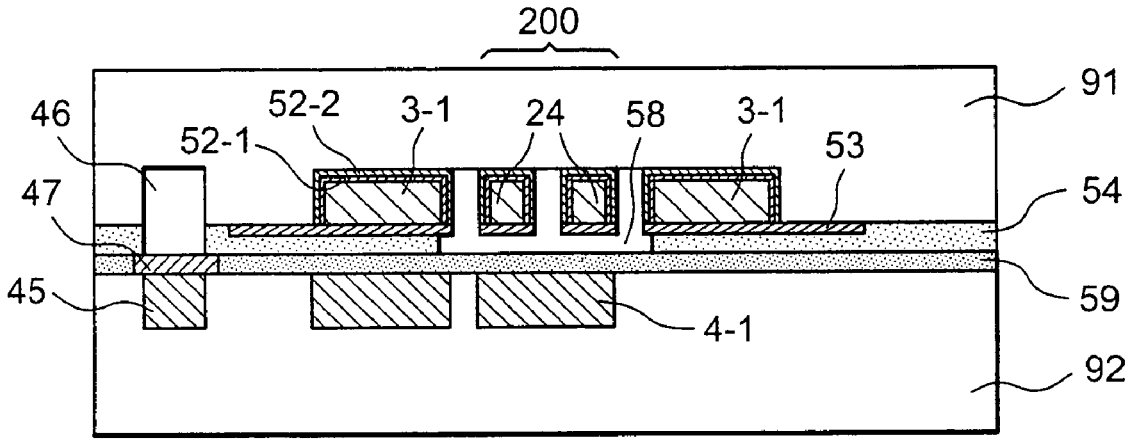
FIGS. 6A and 6B show the steps for assembling and finishing the substrates obtained in FIGS. 3I and 5G.
Figure 6B:
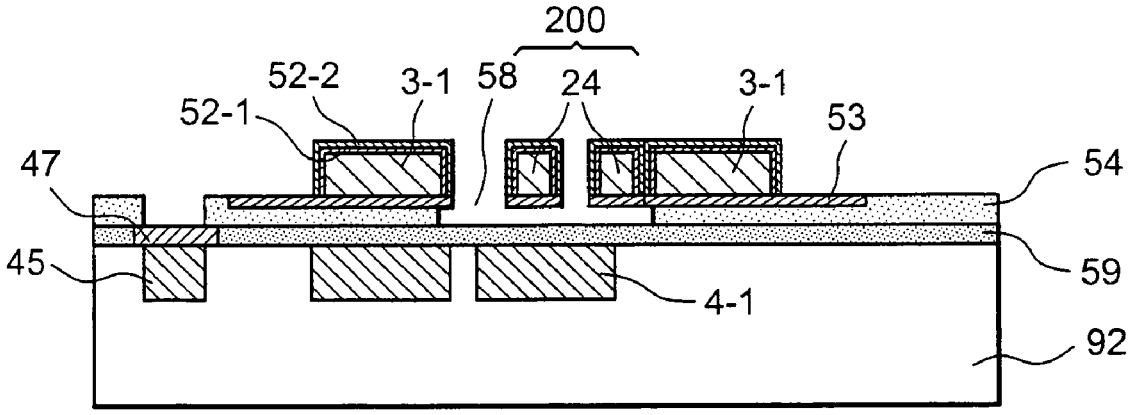
Figure 7A:
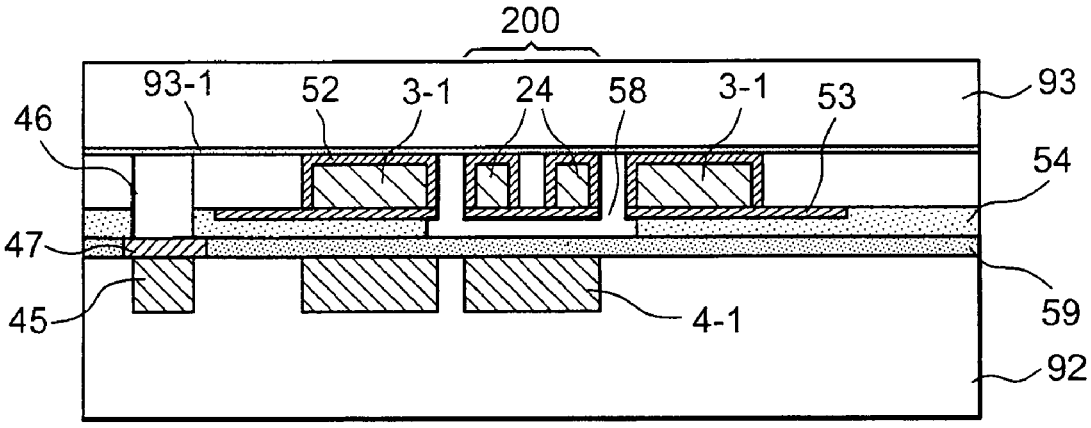
FIGS. 7A and 7B show the steps for assembling and finishing the substrates obtained in FIGS. 4I and 5C.
Figure 7B:
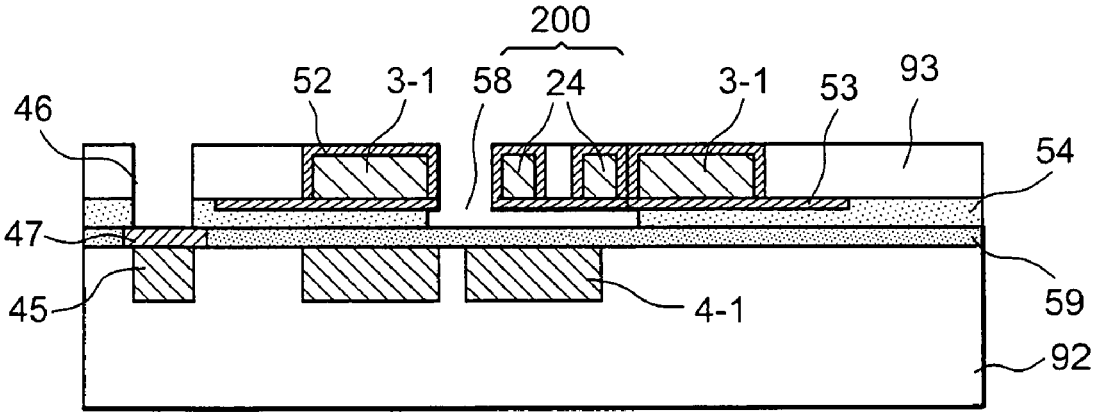

In FIGS. 7A, 7B, the microactuator is found totally embedded in a substrate made in two assembled portions. In FIGS. 6A, 6B, only the means for triggering the displacement are embedded in the substrate also made in two assembled portions, the mobile and fixed magnetic portions are placed on the substrate. In FIGS. 6A, 6B, both portions are massive conventional semiconductor substrates whereas in FIGS. 7A, 7B, one of them is a massive conventional substrate whereas the other is an SOI (Silicon On Insulator) substrate. Such a silicon substrate has a layer of insulating material 93-1, silicon oxide, embedded within the silicon. Its advantage is that when an etching operation is carried out, the insulating material layer may be used as a stop layer.

On a first substrate, either a conventional massive substrate 91 in semiconducting material, or of the SOI type 93, micromagnets 3-1 and 24 will be made for the fixed magnetic portion and for the mobile magnetic portion, respectively. This making is described in FIGS. 3A-3I and 4A-4I. On a second massive substrate 92 in semiconducting material or of the SOI type, means for triggering the displacement will be made, which assume the shape of one or more conductors which may be arranged as a coil (FIGS. 5A-5G). A massive substrate is illustrated in these FIGS. 5A-5G. However, in FIG. 5B, the-position which the insulating material layer of an SOI substrate would assume, is schematized with dotted lines.

One starts with the first substrate 91, 93. The geometry of the magnets is delimited by photolithography. These magnets are those of the fixed magnetic portion and the one or those of the part with reduced magnet weight of the mobile magnetic portion. For this, a resin 50-1 (FIGS. 3A, 4A) is used. The photolithographic mask used takes into account the structure of the part with reduced magnet weight. This mask includes at least one solid or spared portion 500 which corresponds, in the part 200 with reduced magnet weight, to the lesser density portion, which in the example corresponds to a recess 21 of the magnet. This recess may be empty or full of solid material of lesser density. It is assumed that the part 200 with reduced magnet weight is a recessed magnet frame 24 in FIGS. 3 and that it is a magnet frame 24, the recess 21 of which is full of substrate material in FIG. 4.

Cases 51 for the magnets are etched in the first substrate 91, 93. These cases are molds for the portions which will be filled with magnet. The first substrate 91, 93 is not etched at the solid portion 50-2 of the mask. Etching may be dry etching. In the SOI substrate 93, etching stops on the oxide layer 93-1. The resin 50-1 is removed. A conducting adhesive sublayer is deposited on the substrate 91, 93. In fact, this alternative is only found in FIG. 4B.

Figure 3A:
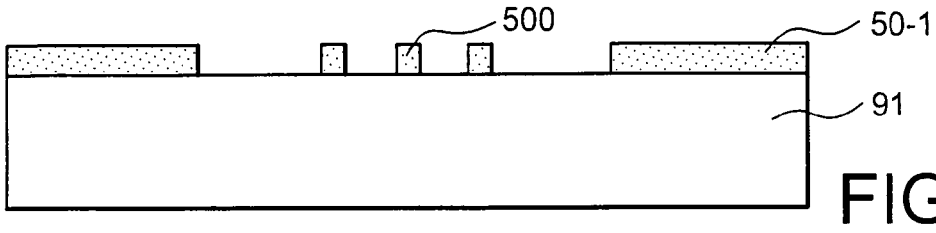
FIGS. 3A-3I show different steps for making the fixed and mobile magnetic portions of an actuator according to the invention, on a massive semiconductor substrate.
Figure 3B:
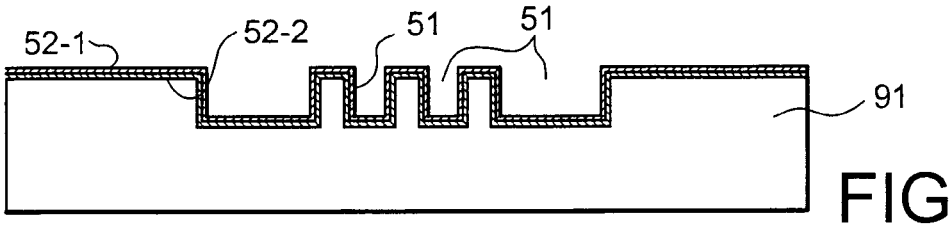

In FIG. 3B, there are two adhesive sublayers 52-1, 52-2, the second one 52-2 being inserted between the first 52-1 and the substrate 91. It provides good adhesion of the first sublayer 52-1 to the substrate 91. It also provides protection against corrosion of the magnet frame 24 made subsequently. The first sublayer may be in gold and the second one in titanium. Both of these sublayers may be used in the example of FIG. 4B.

Figure 3C:
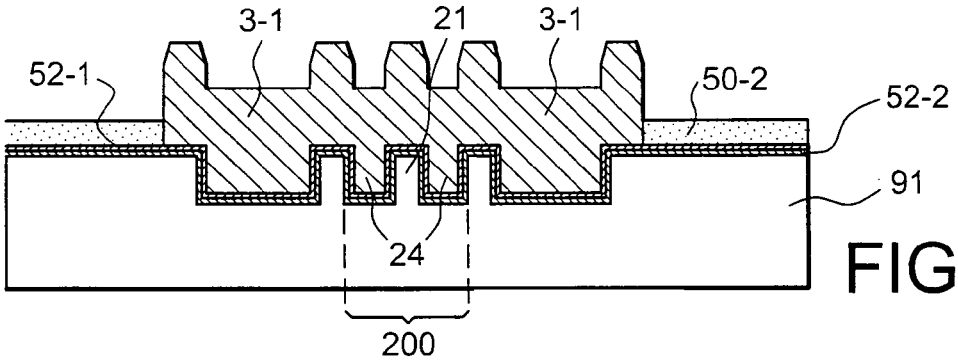
Figure 4A:
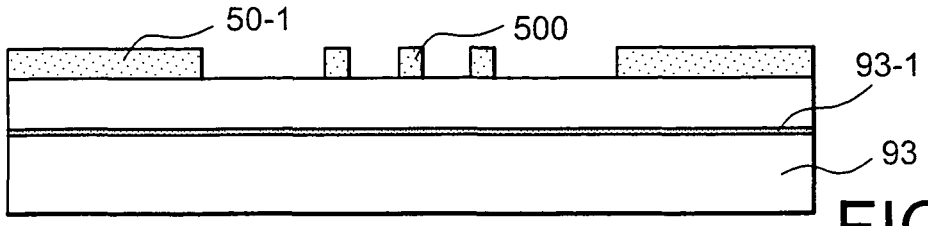
FIGS. 4A-4I show different, steps for making the fixed and mobile magnetic portions of an actuator according to the invention, on a semiconductor substrate of the SOI type.
Figure 4B:
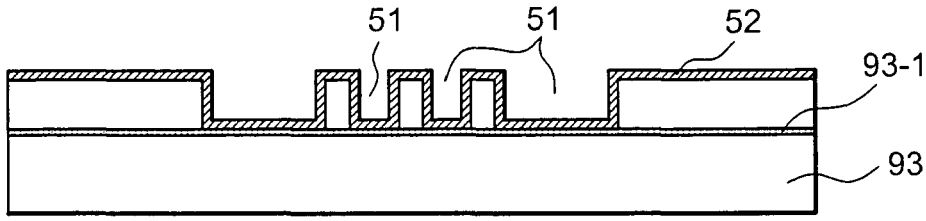
Figure 4C:
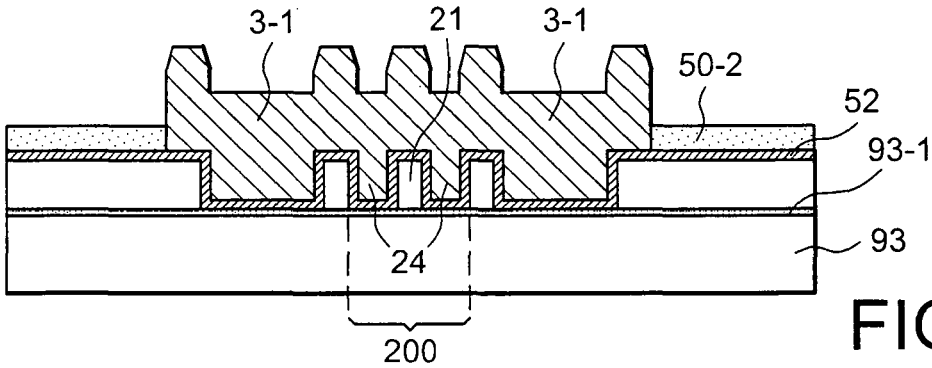
Figure 4D:
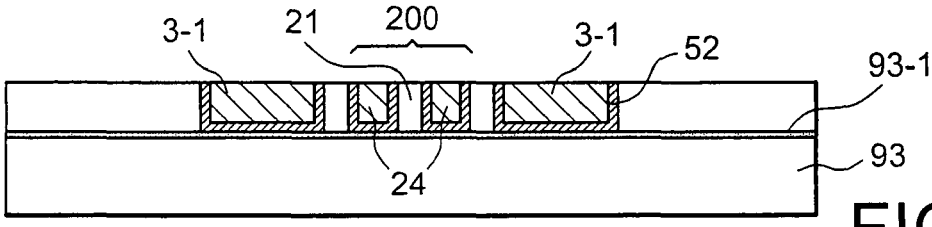

The area for depositing the magnets is defined by photolithography. The resin layer used bears reference 50-2. The magnets 3-1, 24 are deposited electrolytically. The material used may be cobalt-platinum (FIGS. 3C, 4C).

Figure 3D:
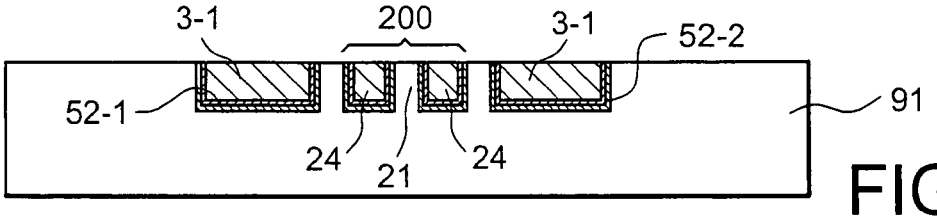

After a step for removing the resin 50-2, a planarization step for the magnets is carried out followed by a step for removing the sublayer 52 at the surface (FIGS. 4D) and both sublayers 52-1, 52-2 (FIG. 3D).

Next, a conducting surface layer 53 may be deposited for achieving electric contacts C1, C2 on the magnets 3-1 of the fixed magnetic portion and C on the frame 24 of the mobile magnetic portion.

Figure 3E:
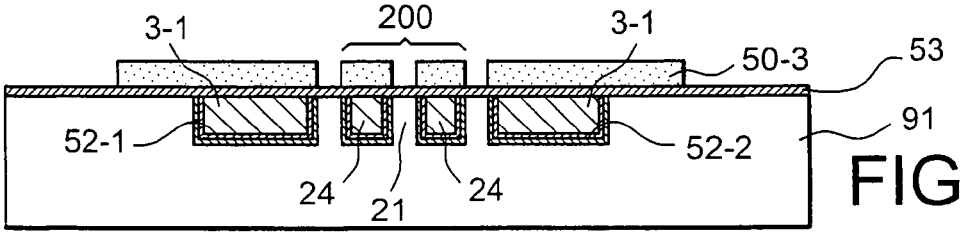
Figure 4E:
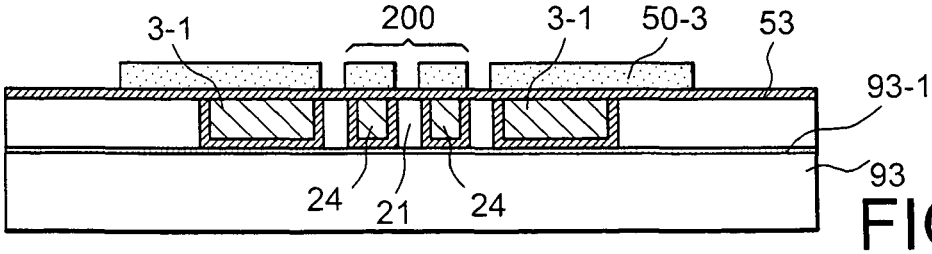

The geometry of the contacts C1, C2, C is defined by photolithography. The resin bears reference 50-3 (FIGS. 3E, 4E). As all the magnets are made in the same time, the mobile magnet 24 also bears a conducting layer on its upper face, it has a protective role against corrosion. In FIGS. 3E and 4E, the resin 50-3 spares the recess 21 of the mobile magnetic portion 200.

Figure 3F:
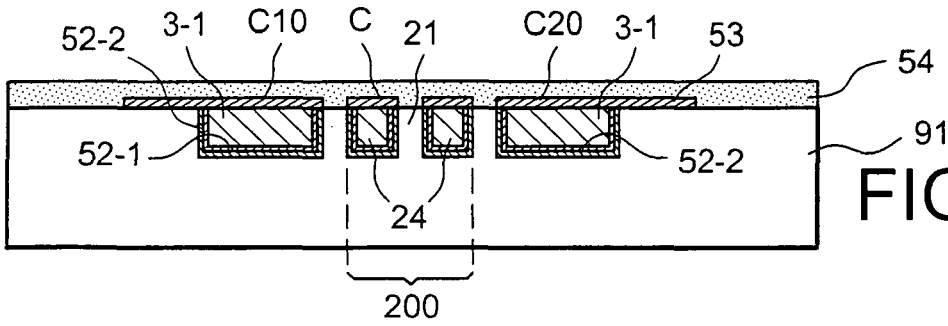

The following step is a step for etching the conducting layer 53 in order to delimit the contacts C1, C2, C. In FIG. 3F, the conducting layer 53 is removed by etching at the recess 21 of the part with reduced magnet weight 200, the material of the substrate found at recess 21 will be subsequently removed as it will be seen in FIG. 3I. In FIG. 4F, the conducting layer 53 is not removed at the recess 21 of the part with reduced magnet weight 200. It prevents the etching step of FIG. 4I from etching the material of the substrate which fills the recess.

The resin 50-3 is then removed. An insulating layer 54 in $SiO_2$ for example, is deposited at the surface and then a planarization step is carried out (FIGS. 3F, 4F).

Figure 3G:
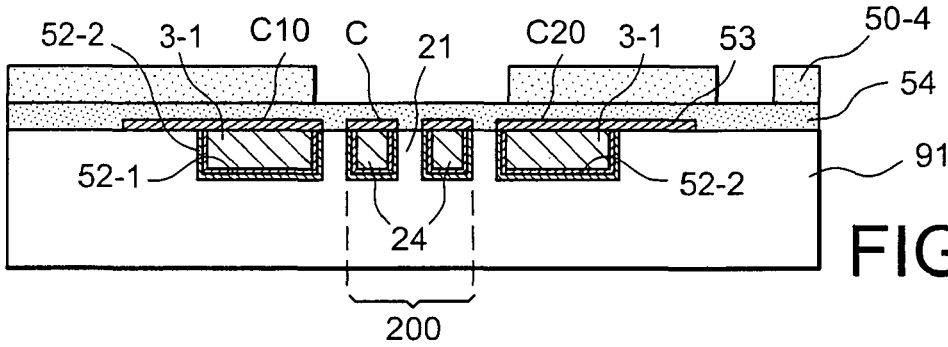
Figure 4F:
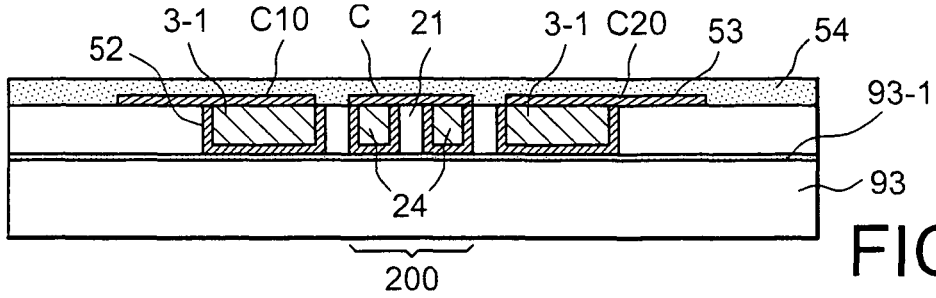
Figure 4G:
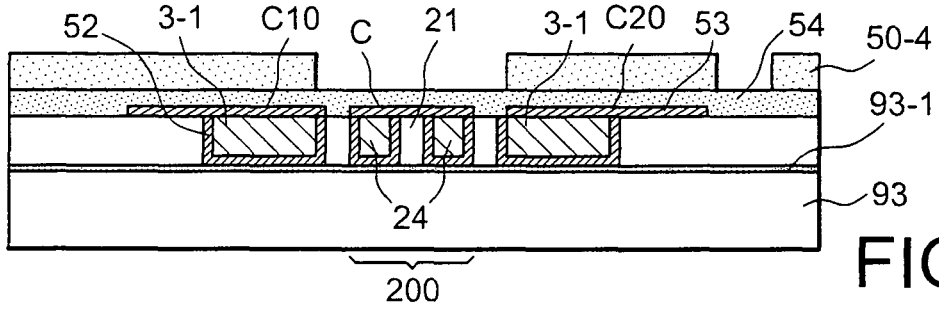

Next, at least one aperture 46 for providing access to the contacts for supplying power to the conductor(s) to be made on the second substrate will be defined, as well as the geometry of a front free space 58 surrounding the part 200 with reduced magnet weight of the mobile magnetic portion so as to allow its displacement. This step is a photolithographic step and the resin used bears reference 50-4 (FIGS. 3G, 4G). The resin 50-4 spares the part 200 with reduced magnet weight.

Figure 3H:
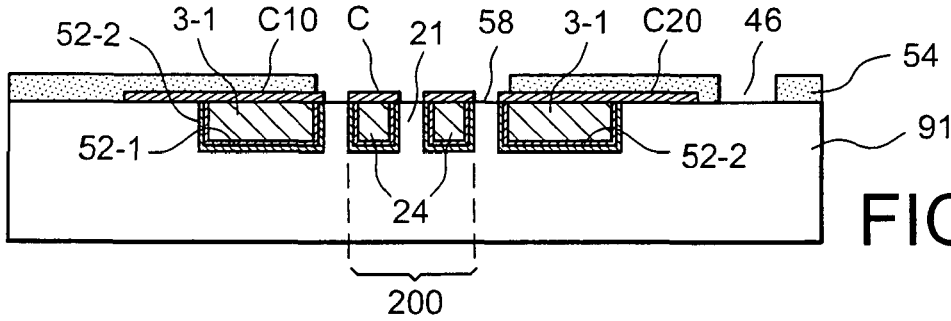
Figure 4H:
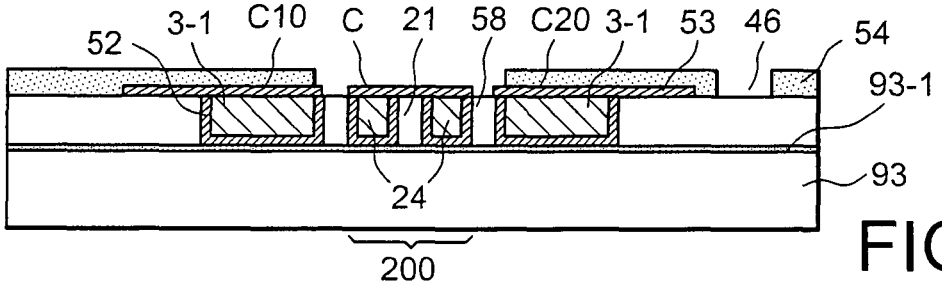

Next, the insulating layer 54 will be etched where there is no resin 50-4. The resin 50-4 is removed (FIGS. 3H, 4H). The part 200 with reduced magnet weight is then exposed as well as its surroundings 58 up to the fixed magnets 3-1 (FIG. 3H, 4H).

Figure 4I:
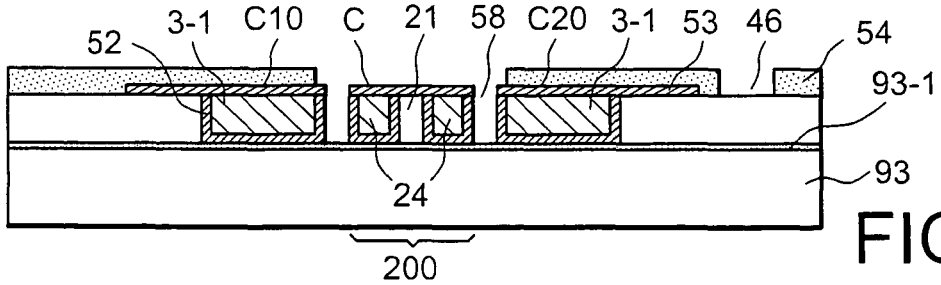

Dry etching of the substrate 93 is then carried out at the space 58 around the part 200 with reduced magnet weight, at the aperture 46, this etching stops on the insulating layer in the case of the SOI substrate 93 (FIG. 4I). The layer 53 which covers the recess 21 prevents it from being etched since in this configuration it is full of material of the substrate 93.

Figure 3I:
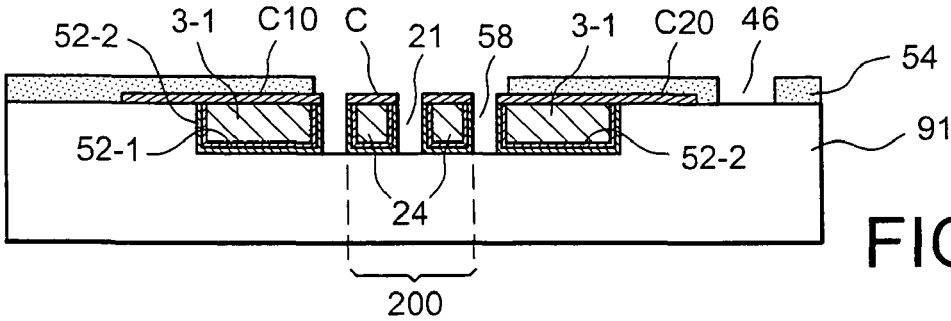

In FIG. 3I, dry etching of the substrate 91 is carried out around the part 200 with reduced magnet weight, at the aperture 46, as well as at the recess 21 inside the frame 24. Thus, the recess 21 is emptied of the material of the substrate 91.

It is assumed that the means 30 for triggering the displacement are similar to those of FIG. 2A.

Figure 5A:
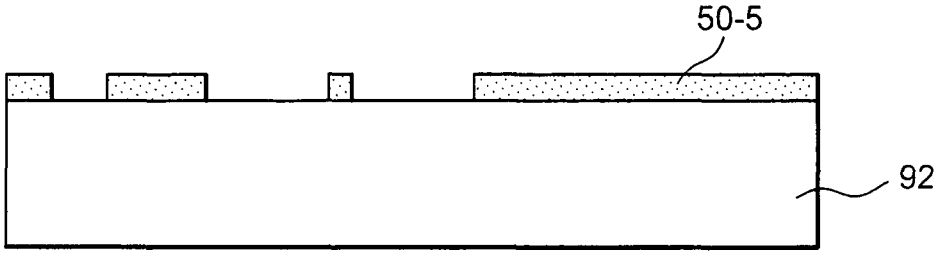
FIGS. 5A-5G show different steps for making the means for triggering the displacement of the mobile magnetic portion of an actuator according to the invention, on a semiconductor substrate.
Figure 5B:
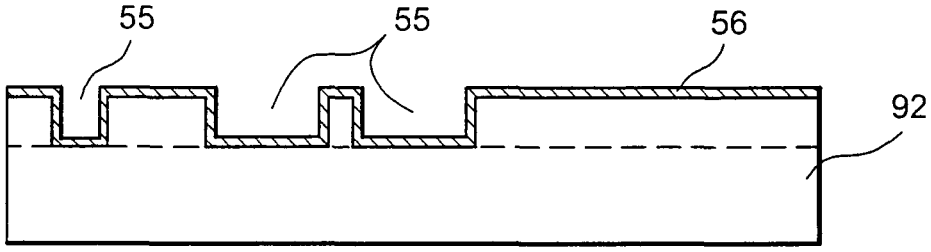

On the second substrate 92, the geometry of the conductor 4-1 and its ends 45 which should bear the power supply contacts, are defined by photolithography. The resin used bears reference 50-5 (FIGS. 5A).

Etching of a case 55 which should receive the conductor 4-1 is carried out. In an SOI substrate, etching of the case 55 stops on the insulating layer. The depth of the case 55 corresponds to the thickness of the conductor 4-1. After removing the resin 50-5, a conducting adhesive sublayer 56 (FIG. 5B) is deposited at the surface. It may be made in copper for example. A second sublayer as described in FIG. 3B may also be introduced. It may be made in titanium for example.

Figure 5C:
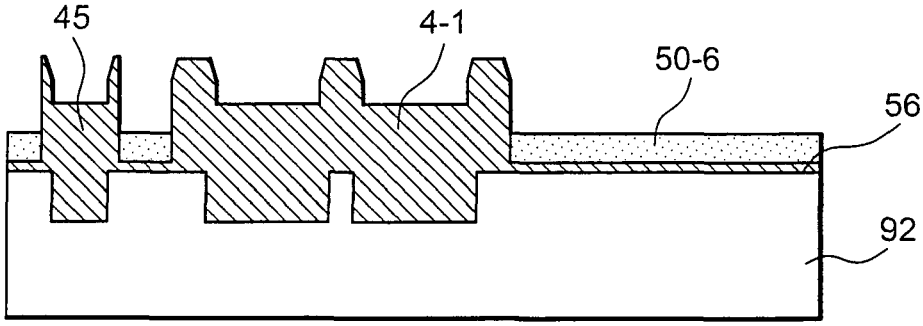

The area for depositing the conductor is defined by photolithography. The resin used bears reference 50-6. The conductor 4-1 is deposited electrolytically, its referenced ends 45 are well visible (FIGS. 5C). The coating may be copper.

Figure 5D:
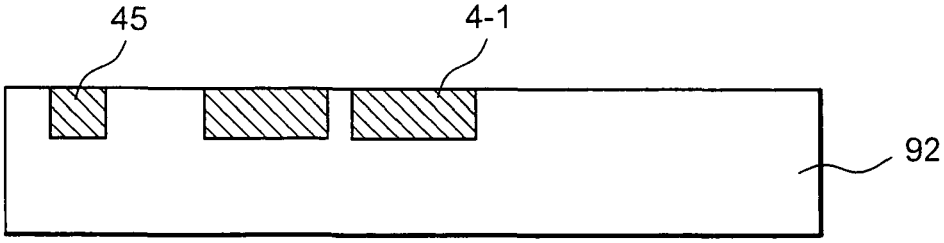

The resin 50-6 is removed, the conducting coat is planarized. The conducting sublayer 56 is etched at the surface in order to remove it (FIG. 5D).

Figure 5E:
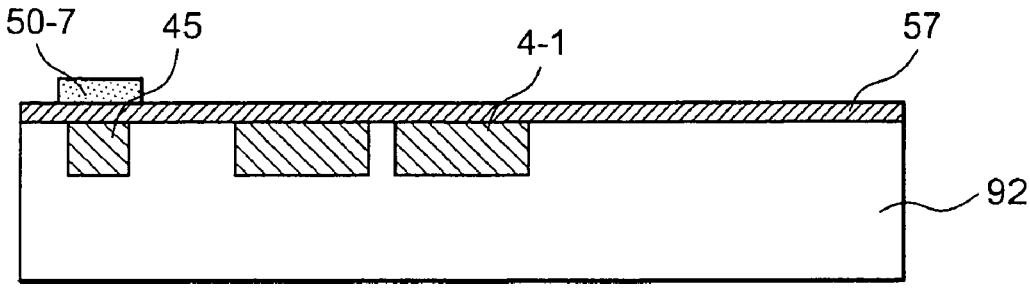

A conducting layer 57 is then deposited at the surface, for making contacts 47 for supplying power to the conductor 4-1, these contacts 47 covering the ends 45 of the conductor 4-1. The geometry of the contacts 47 is defined by photolithography, the resin used for this bearing reference 50-7 (FIG. 5E).

Figure 5F:
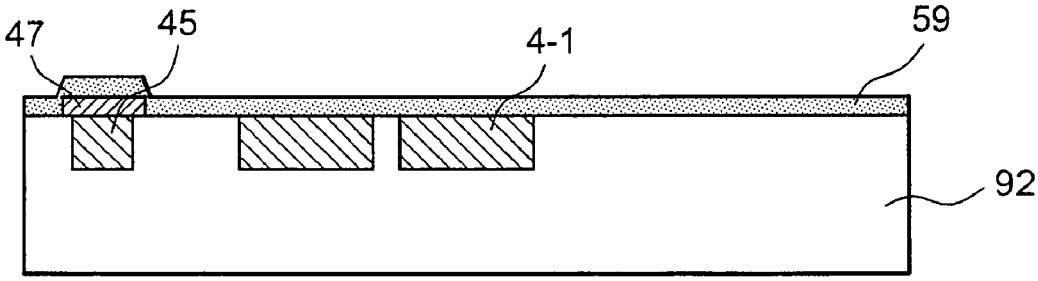

Next, the conducting layer 57 is etched so as to remove it everywhere it is not protected by the resin 50-7. After removing the resin 50-7, an insulating layer 59 is deposited at the surface. It may be made in silicon oxide $SiO_2$. It will insulate the conductor 4-1 from the magnets 3-1, 24 during assembly of the first substrate 91, 93 and of the second substrate 92 (FIG. 5F).

Surface planarization is achieved and the contacts 47 (FIG. 5G) are exposed.

Figure 5G:
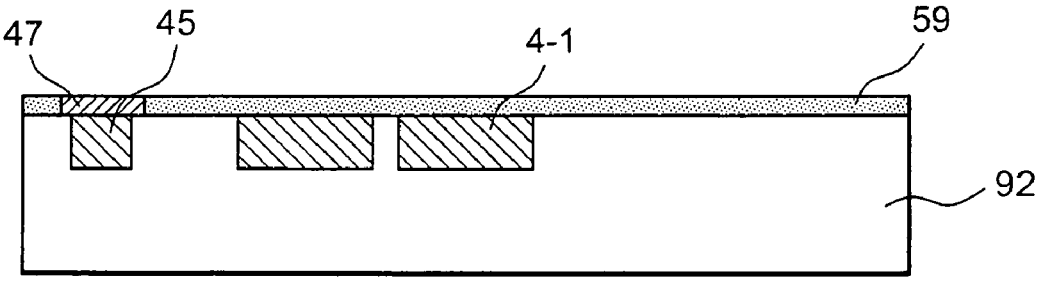

The substrate of FIG. 3I and the substrate of FIG. 5G (FIG. 6A) or the substrate of FIG. 4I and the substrate of FIG. 5G (FIG. 7A) will then be assembled by an adhesive, by putting them face to face.

Now, it should be ensured that the magnets 3-1, 24 are magnetized as otherwise, upon releasing the part 200 with reduced magnet weight, it would not be attracted by the fixed magnets 3-1 which themselves remain firmly attached to the substrate by the adhesive sublayer.

The first substrate 91, 93 will be removed totally or partially. This may be by mechanical thinning and/or chemical etching. In FIG. 6B, the substrate 91 was completely removed whereas in FIG. 7B, removal stopped on the oxide layer 93-1 and the silicon of the substrate 93, found below, remains in place. One finishes by removing the oxide layer 93-1. The magnets 3-1, 24 are then embedded into the substrate formed with two assembled portions 92 and 93, whereas in FIG. 7B, they are at the surface of the substrate 92.

Although several embodiments of the present invention were illustrated and described in detail, it will be understood that different changes and alterations may be made without departing from the scope of the invention.

The invention claimed is:

1. A magnetic actuator, comprising:

a mobile magnetic portion including a magnet-based part with reduced magnet weight, the reduced magnet weight magnet-based part having an overall volume in which the reduced magnet weight occurs, and a mass, the mass of the reduced magnet weight part is less than the mass of a part having the same overall volume and whose overall volume is totally occupied by the magnet;

a fixed magnetic portion provided with at least two attraction areas for the mobile magnetic portion, and means for triggering the displacement of the mobile magnetic portion, the mobile magnetic portion being in levitation when it is not in contact with one of the attraction areas, wherein the reduced magnet weight part comprises, in the direction of the displacement, a first magnet bar and a second magnet bar, the first and second magnet bars having a same magnetization orientation, and the first and second magnet bars being spaced by a lesser density portion having a density less than that of the magnet bars, wherein said means for triggering the displacement includes at least one conductor arranged as at least two meanders each formed with sections of successive conductors in which a current flows in opposite directions, and wherein, when the mobile magnetic portion is stuck on one of said attraction areas, the first and second magnet bars cooperate with one of the sections (31.1 or 31.2), and the current flows in the same direction in said one of the sections.

2. The magnetic actuator according to claim 1, wherein the lesser density portion includes at least one recess (21, 27) empty of solid material.

3. The magnetic actuator according to claim 2, wherein the recess is a through hole.

4. The magnetic actuator according to claim 1, wherein the lesser density portion includes at least one recess filled with a solid material having a density less than that of the magnet bars.

5. The magnetic actuator according to claim 4, wherein the solid material is selected from semiconducting material, plastic material, soft magnetic material, dielectric material.

6. The magnetic actuator according to claim 1, wherein the reduced magnet weight part (200) is a substantially rectangular plate.

7. The magnetic actuator according to claim 1, wherein the reduced magnet weight part (200) includes a magnet frame (24).

8. The magnetic actuator according to claim 1, wherein the first and second magnet bars are orientated substantially normal to the displacement.

9. The magnetic actuator according to claim 1, wherein the first and second magnet bars are respectively located at each end of the mobile magnetic portion.

10. The magnetic actuator according to claim 9, wherein the first and second magnet bars have a dimension in the direction of the displacement, substantially equal to the displacement.

11. The magnetic actuator according to claim 1, wherein each attraction area (11, 12) has a geometry conjugate to that of the face of the mobile magnetic portion (20) which must come into contact with it.

12. The magnetic actuator according to claim 1, wherein at least one of the attraction areas (11) includes a dielectric portion (111) so as to achieve capacitive contact when the mobile magnetic portion (20) is stuck on said attraction area.

13. The magnetic actuator according to claim 1, wherein the first magnet bar is associated with one of said at least two meanders, and the second magnet bar is associated with another of said at least two meanders.

14. The magnetic actuator according to claim 1, wherein the current is a pulse current always circulating in a same direction, said pulse current triggering the displacement of the mobile magnetic portion towards one of the attraction areas regardless of the position of the mobile magnetic portion.

15. The magnetic actuator according to claim 1, wherein the first and second magnet bars generate a magnetic field having a direction, a magnetic field being established in the lesser density portion, said magnetic field established in the lesser density portion having a direction opposite to the direction of the magnetic field generated by the first and second magnet bars.

* * * * *

UNITED STATES PATENT AND TRADEMARK OFFICE

CERTIFICATE OF CORRECTION

PATENT NO. : 7,834,727 B2
APPLICATION NO. : 10/562748
DATED : November 16, 2010
INVENTOR(S) : Jerome Delamare et al.

It is certified that error appears in the above-identified patent and that said Letters Patent is hereby corrected as shown below:

In Column 4, line 30, please delete "5C" and insert therefore --5G--.

In Column 4, line 49, please insert --actuator-- after "magnetic" and "before".

In Column 6, line 63, please delete the "," after "not" and before "to".

Signed and Sealed this
Twenty-fifth Day of January, 2011

David J. Kappos

David J. Kappos
*Director of the United States Patent and Trademark Office*